United States Patent [19]

Hewitt

[11] 3,986,813

[45] Oct. 19, 1976

[54] INTERMITTENT PILOT IGNITER AND VALVE CONTROLLER FOR GAS BURNER

[75] Inventor: William Lloyd Hewitt, Los Angeles, Calif.

[73] Assignee: Cam-Stat Incorporated, Los Angeles, Calif.

[22] Filed: June 26, 1975

[21] Appl. No.: 590,410

Related U.S. Application Data

[63] Continuation-in-part of Ser. No. 563,489, March 31, 1975, abandoned.

[52] U.S. Cl. ..... 431/46; 431/80

[51] Int. Cl.[2] ..... F23N 5/10

[58] Field of Search ..... 431/78, 43, 42, 80, 431/46

[56] References Cited

UNITED STATES PATENTS

| | | | |
|---|---|---|---|
| 2,924,270 | 2/1960 | Deziel | 431/43 X |
| 3,519,376 | 7/1970 | Dietz | 431/43 |
| 3,704,980 | 12/1972 | Lokkart | 431/43 |

*Primary Examiner*—Edward G. Favors

*Attorney, Agent, or Firm*—Harris, Kern, Wallen & Tinsley

[57] ABSTRACT

A system for controlling the pilot and main burner gas valves of a gas furnace or the like, including a pilot spark igniter and a pilot flame sensor. A relay having a first standby mode providing power to the spark igniter circuit when the thermostat switch is closed and the pilot valve solenoid is energized, and a second operating mode disconnecting power from the spark igniter circuit and providing power to the main valve solenoid when a flame is sensed at the pilot burner. A fast responding, stable and failsafe circuit for operating the relay utilizing a 24 volt supply, with a 48 volt supply provided only for the flame sensor.

15 Claims, 2 Drawing Figures

INTERMITTENT PILOT IGNITER AND VALVE CONTROLLER FOR GAS BURNER

CROSS REFERENCE TO RELATED APPLICATION

This application is a Continuation-In-Part of copending application Ser. No. 563,489, filed Mar. 31, 1975 now abandoned.

BACKGROUND OF THE INVENTION

This invention relates to gas burner controls for furnaces and the like, and in particular to a new and improved pilot burner gas igniter and main burner valve controller. The system utilizes a pilot burner flame sensor and a fast responding solid state electronic control circuit for switching the main burner solenoid valve and the pilot burner spark igniter circuit.

A typical system of this type is energized when the electrical contacts of a thermostat close in response to a drop in temperature of the area being heated by the gas furnace. When the thermostat switch closes, the pilot burner valve is opened and the spark igniter circuit provides sparking at the pilot igniter electrodes and the gas at the pilot burner should ignite. The flame sensor and control circuit detects the existence of the flame and actuates a switching circuit to energize the main burner valve and turn off the spark igniter circuit. If flame outage occurs, the flame sensing circuitry will detect the absence of flame and close the main burner valve, while at the same time turning on the spark igniter for reigniting the pilot burner.

Systems of this general type are known. One type of prior art system omits the pilot burner, placing the igniter and sensor at the main burner. However, this type of system is usually considered unsatisfactory for larger capacity burners because of the possibility of explosion resulting from accumulation of gas prior to ignition. Another type of prior art system does not utilize the spark igniter, maintaining the pilot burner on at all times. However this type of system is undesirable because of the waste of gas with the continuously burning pilot.

The most pertinent prior art system presently known to applicant is the Penn Baso cycling pilot ignition system Series G60. In this system, closing of the thermostat switch energizes the solenoid of the pilot burner valve and the spark igniter circuit to produce the pilot flame. The pilot flame is sensed and utilized in a control circuit for actuating a relay to energize the main burner valve solenoid and turn off the spark igniter circuit. The furance control systems normally are operated from a 24 volt ac source. However, this prior art system requires a 100 volt ac supply, with the flame sensor, the control circuit and the relay being operated from the 100 volt secondary of a voltage step-up transformer.

Another prior art system is shown in U.S. Pat. No. 3,619,097. This sytem omits the pilot burner and utilizes the flame sensor for controlling the main burner valve solenoid and the spark ignition circuit. This prior art system also requires a 100 volt ac supply for the control, switching and spark igniter circuits.

Two other prior art systems are shown in U.S. Pat. Nos. 3,574,496 and 3,610,790. The first patent describes a more complex system which operates from a 100 volt source and utilizes a flame rod sensor and a flame ultraviolet sensor, while omitting the pilot burner. The second patent shows another complex system which omits the pilot burner and utilizes one of the spark ignition electrodes as the flame sensor.

It is an object of the present invention to provide a new and improved furnace control system having improved sensitivity and fast response to flame outage and operable at relatively low voltage with a resultant saving in cost and electrical insulation problems. A further object is to provide such a system suitable for high capacity burners and utilizing a pilot burner, and one which has a fail safe characteristic for all components of the system.

SUMMARY OF THE INVENTION

A pilot ignition and valve control system for a gas burner having a main burner, a main valve operated by a main solenoid for providing gas to the main burner, a pilot burner, a pilot valve operated by a pilot solenoid for providing gas to the pilot burner, and a flame sensor and ignition electrodes adjacent said pilot burner. The system includes an ignition circuit for providing energy to the ignition electrodes, a switching circuit for switching the power source turned on by a thermostat switch between the ignition circuit and the main burner valve solenoid, and a control circuit responding to the flame sensor for controlling the switching circuit. The control circuit, the switching circuit, the ignition circuit and the valve solenoids are operable from a 24 volt ac source, with a microminiature transformer providing a 48 volt supply for the flame sensor. The rectification characteristic of a flame is used to provide a signal to a field effect transistor when the flame is present to charge a capacitor, with capacitor discharge through one or more diodes triggering a controlled rectifier in the switching circuit. A synchronized voltage switching circuit is utilized in the presently preferred embodiment.

DESCRIPTION OF THE PREFERRED EMBODIMENTS

Figure 1:
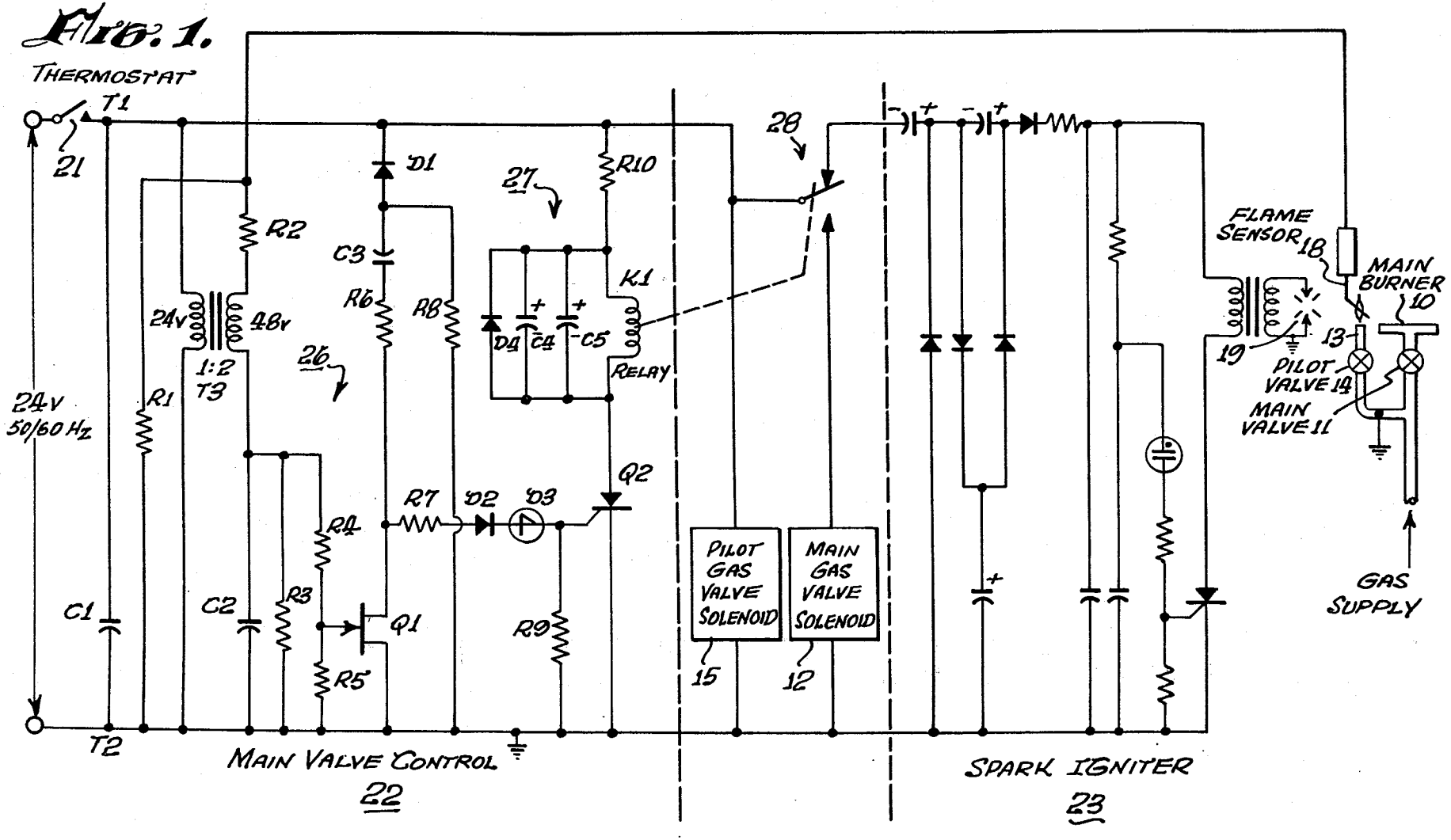
FIG. 1 is an electrical schematic of a furnace control incorporating one embodiment of the invention.

Referring to FIG. 1, the gas flow to a main burner 10 is controlled by a valve 11 actuated by a valve solenoid 12. Gas flow to a pilot burner 13 is controlled by a valve 14 actuated by a valve solenoid 15. A rod type flame sensor 18 and a pair of ignition electrodes 19 are positioned adjacent the pilot burner 13. All of these components may be conventional.

A conventional thermostat switch 21 serves to connect a 24 volt ac power supply across terminals T1, T2 when the main burner is to be turned on. The circuitry in the drawing includes a main valve control 22 and a spark igniter circuit 23. The main valve control 22 includes a voltage step-up transformer T3, a control circuit 26, and a switching circuit 27.

The switching circuit includes a relay K1 with the relay coil connected in series with a controlled rectifier Q2 and a resistor R10 across the terminals T1, T2. The pilot gas valve solenoid 15 is also connected across the terminals T1, T2. With the relay coil in the unenergized condition, the relay contacts 28 connect the spark igniter circuit 23 across the terminals T1, T2, and with the relay coil energized, the relay contacts connect the main gas valve solenoid 12 across the terminals T1, T2.

The spark igniter circuit 23 may be a conventional circuit with a voltage multiplier and pulsing circuit providing ignition pulses at the electrodes 19. Typical spark igniter circuits are shown in U.S. Pat. No. 3,813,581 and other patents cited therein.

The primary winding of transformer T3 is connected across the terminals T1, T2. The secondary winding of the transformer T3 is connected in a loop with a current limiting resistor R2, the flame sensor 18, and pilot burner 13 and a capacitor C2. Resistor R3 and the series combination of resistors R4 and R5 are connected across capacitor C2, with the junction of resistors R4 and R5 connected to the gate of a field effect transistor Q1. A diode D1, a capacitor C3 and a resistor R6 are connected in series with the source and drain of transistor Q1 across the terminals T1, T2, with the drain connected to the gate of controlled rectifier Q2 through resistor R7 and diodes D2, D3. Typical values for the components of the main valve control 22, and the functions of the components are set out in the following tabulation.

| Component | Description | Component Function |
|---|---|---|
| C1 | .01 MFD capacitor | Transient suppressor. |
| C2 | .01 MFD capacitor | Flame-rectified energy storage capacitor, used to bias off Gate of Q1 FET when Source is negative. Energy can only be stored in the presence of a pilot flame. |
| C3 | .22 MFD capacitor | Energy storage capacitor for triggering zero-voltage switching of Q2 SCR. |
| C4, C5 | 10 MFD capacitor | Energy storage capacitors which keep K1 relay energized during the period when Terminal T1 is negative. Two capacitors used to prevent relay from chattering if one capacitor should go open. |
| R1 | 51 megohm resistor | Shunt resistor used to increase stability of flame signal transformer T3. |
| R2, R4 | 1.3 megohm resistor | Limiting resistors. |
| R3, R5 | 22 megohm resistor | Bleed resistors for C2 capacitor |
| R6, R7 | 1.0 Kohm resistor | Limiting resistors. |
| R8 | 1.8 Kohm resistor | Provides a trigger signal discharge path for energy stored in C3 when Terminal T2 is negative. |
| R9 | 1.0 Kohm resistor | Gate shunt resistor. |
| R10 | 1.0 ohm resistor | Flame-proof fuse resistor. If Q2 SCR should short circuit there will be excessive current through R10, D4 and Q2, which causes R10 to go open with no fire hazard. |
| D1 | IN4003 diode | Half-wave rectifier. |
| D2 | IN4003 diode | D2 is a blocking steering diode; it prevents C3 from being charged when T2 goes positive. However, on the alternate half cycle D2 provides a trigger signal path to the Gate of Q2 from C3. |
| D3 | 2N4987 Unilateral Trigger Diode | D3 performs the same function as D2. However, in addition it generates a sharp leading edge pulse which improves the turn-on characteristics of SCR Q2 in extremely low temperatures. |
| D4 | IN4003 diode | Shunt diode to allow R10 to open if Q2 should short circuit. |
| Q1 | 2N5952 FET | Flame sensor amplifier and trigger signal controller. |
| Q2 | C106 SCR | Relay controller. |
| T3 | 72-0953-0 Transformer | 48 V flame signal source. |
| K1 | Relay | Igniter and valve control operator. |

The entire system is off when the thermostat switch 21 is open. The system is energized when the thermostat switch 21 closes as the temperature in the area being heated drops. Closing of switch 21 applies power to the pilot solenoid 15 and opens pilot valve 14 providing gas to the pilot burner 13. Closing of switch 21 also applies power to the spark igniter circuit 23 through the relay contacts at 28 producing sparking between the electrodes 19 and the pilot gas should ignite. The presence of a pilot flame is sensed and relay K1 is energized within about 70 milliseconds after ignition. When relay K1 is energized, the power source is disconnected from the spark igniter circuit 23 and is connected to the main gas valve solenoid 12. The sparking ceases at the electrodes 19, the main valve 11 is opened, and the gas at the main burner 10 is ignited by the pilot flame. When the flame at the burner goes out for any reason, the relay K1 is de-energized, which de-energizes the main valve solenoid shutting off gas to the main burner, and energizes the spark igniter circuit to reignite the pilot burner.

After the thermostat switch closes but before the pilot burner ignites, the system is in a first or standby mode. The field effect transistor Q1 is an N channel depletion mode type device. With ac power at terminals T1, T2 and zero bias voltage between the gate and source, there is a current path between the drain and source which allows the capacitor C3 to charge and discharge through the resistor R6 when terminal T1 is negative. This current path has an impedance of about 300 ohms and hence is the path of least resistance for the capacitor C3 to discharge. Accordingly, the rectifier Q2 remains de-energized or off since the energy stored in the capacitor C3 is discharged to ground.

The system is switched to a second or operating mode when the pilot burner ignites. The alternating current supplied by the secondary winding of transformer T3 is rectified due to the known rectifying characteristic of flames. This rectification causes the capacitor C2 to store a negative dc voltage at the gate of transistor Q1. The energy stored in the capacitor C2 is stored only for a few milliseconds because of the discharge path through resistors R3, R4 and R5. Therefore the energy stored in the capacitor C2 must be replenished constantly. The negative voltage at the gate serves to turn the transistor Q1 to the off or nonconducting condition when the source potential (terminal T2) goes negative. When the source potential becomes positive on the next half cycle, the transistor Q1 conducts and allows the capacitor C3 to charge. The transistor Q1 is again turned off in the next half cycle and the energy stored in capacitor C3 can only be discharged through the path resistor R6, resistor R6, diode D2, diode D3 and resistor R9. Capacitor discharge through this path provides a trigger pulse at the gate of controlled rectifier Q2, making the rectifier conductive and energizing the coil of relay K1. The relay K1 remains energized so long as the secondary voltage of the transformer T3 is being rectified at the pilot burner flame. When the flame goes out, the relay is de-energized within a few cycles of the ac source. Of course, the relay is also de-energized when the thermostat switch opens.

The system of the present invention operates with a 24 volt power source, as contrasted to the 100 volt requirement of the prior art systems. This permits manufacture of a less expensive unit with smaller components. The transformer T3 provides a 2 to 1 voltage stepup for the flame sensor, with no other loading and therefore can be quite small and inexpensive. The rectification efficiency of a flame is very low and therefore prior art systems have required a 100 volt supply on the flame sensor also, while the present system provides the same or improved sensitivity with one-half the voltage.

While reference is made herein to a 24 volt ac supply, is should be realized that this value is given by way of example and that higher or lower voltages may be utilized. A typical specification for this type of equipment is that it operate with supply voltages over the range of 18 to 32 volts ac.

All of the circuits are designed for failsafe operation, that is any failure in a circuit component either shorting or open circuiting will not result in the main burner valve remaining open in an unsafe condition.

The combination of the field effect transistor Q1, the storage capacitor C3, the diodes D2 and D3 and the controlled rectifier Q2 is similar to that shown in U.S. Pat. No. 3,619,097. However, the circuit of FIG. 1 of the invention utilizes a unilateral trigger diode as the diode D3. Conventional diodes, such as the diodes D1 and D2 break down at 0.8 volts. With the conventional diode in this circuit, a relatively large capacitor C3 is required to provide a sufficient voltage pulse to trigger the rectifier Q2 into conduction. However, the unilateral trigger diode D3 requires a much higher voltage to trigger, after which the impedence drops sharply. Typically the unilateral trigger diode requires about 8 volts across the diode in order to trigger into conduction, after which the drop falls to nearly 0 volts.

Figure 2:
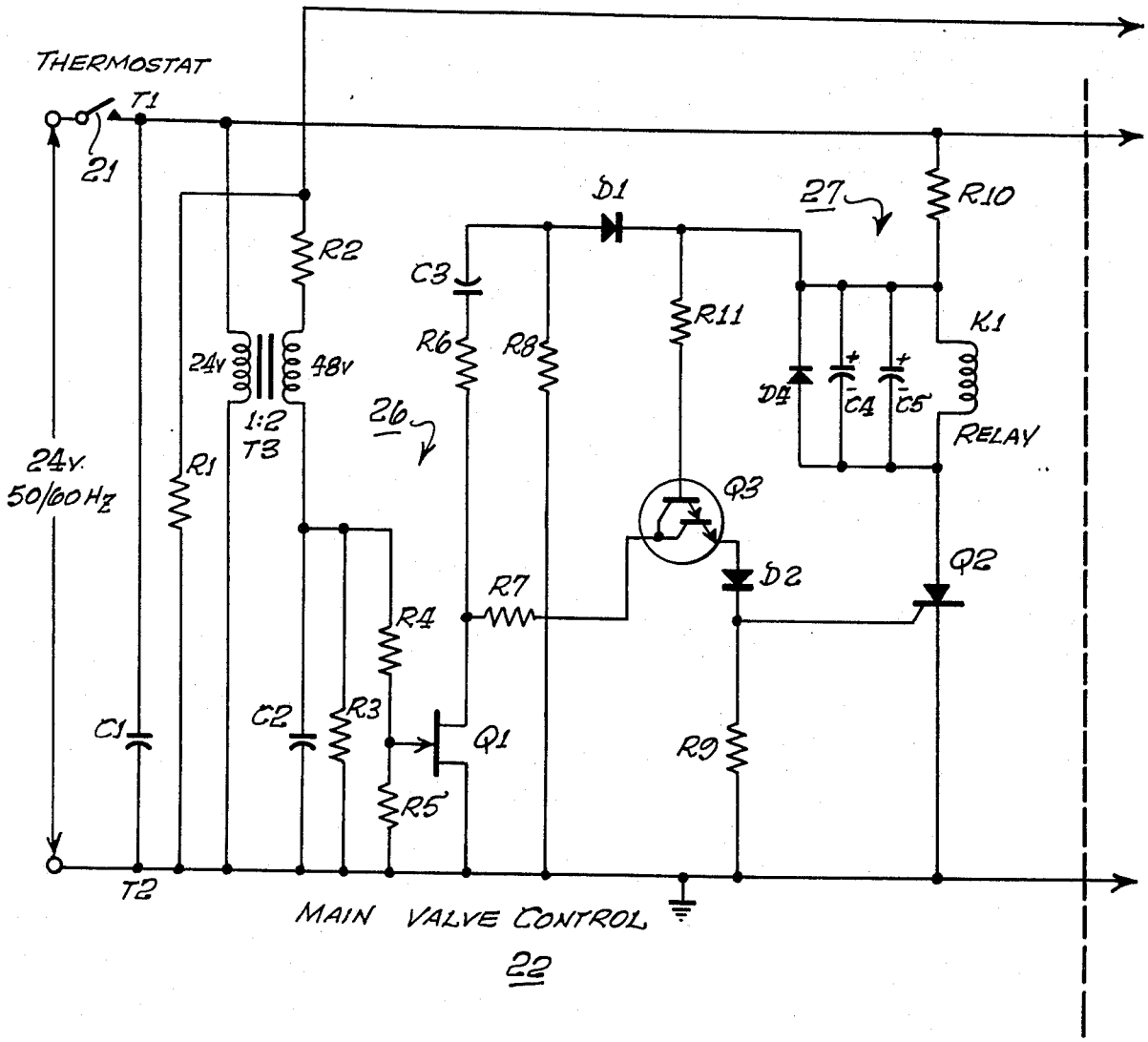
FIG. 2 is an electrical schematic of the main valve control of FIG. 1 showing an alternative embodiment.

An alternative and presently preferred embodiment of the main valve control 22 is shown in FIG. 2. Components corresponding to those of FIG. 1 are identified by the same reference numerals.

A synchronized voltage switching circuit is substituted for the diode D3. The synchronized voltage switch circuit provides the trigger voltage via D2 diode to the gate of the controlled rectifier Q2 at the time the ac supply voltage passes through zero so that the Q2 gate pulse always occurs in synchronism with the ac line pulse. The synchronized voltage switching circuit functions in the main valve control 22 to inhibit the discharge of energy storage capacitor C3 during the period the ac supply line T1 is negative.

A preferred synchronized voltage switching circuit using a Darlington solid state amplifier Q3 is shown in FIG. 2. The amplifier is operated in a high gain, low base current mode with high resistance in the base circuit. After supply line T1 passes through zero, Q3 Darlington amplifier is switched into conduction by current supplied to its base through resistor R11. Accordingly this technique permits a gate trigger pulse to occur only when the anode of Q2 has passed through zero at the start of the positive half cycle when the pulse is most effective in turning on the SCR at very low temperatures. Typically, R11 may be 1.3 megohms and Q3 may be a GET 5306.

The furnace control systems of the type of the present invention often are required to operate at extremely low temperatures, such as −40° F and lower. The presently available controlled rectifiers require higher trigger voltages when operated at lower temperatures. One way to improve the operation of the circuit at lower temperatures is to select individual controlled rectifiers which have lower trigger voltage requirements at low temperatures. This is an expensive process. Another alternative is to utilize a bigger capacitor C3 providing more energy storage. The circuit of the present invention utilizing the unilateral trigger diode or the synchronized voltage switching circuit provides a much higher voltage pulse than the conventional circuits, thereby eliminating the requirement for controlled rectifier selection and also permitting use of a small capacitor, typically a capacitor with half the capacitance rating of the capacitor in the conventional circuit. The circuit of the present invention provides a fast response to the presence of a flame at the pilot burner and to the absence of a flame at the pilot burner, the response time between flame condition change and relay operation typically being less than 50 milliseconds. Also the circuit is extremely stable, maintaining its nominal operating characteristics while subjected to changes in temperature, environment and input voltage, and is immune to unwanted externally generated signals such as transient spikes generated by switching of loads on the line. Further, no unsafe condition will result if the flame sensor is accidentally shorted to ground or to the ignition electrode.

I claim:

1. In a pilot ignition and valve control system for a gas burner having a main burner, a main valve operated by a main solenoid for providing gas to said main burner, a pilot burner, a pilot valve operated by a pilot solenoid for providing gas to said pilot burner, and a flame sensor and ignition electrodes adjacent said pilot burner, the combination of:

a pair of input terminals for connection to an ac power source through a thermostat switch, and for connection to said pilot solenoid whereby said pilot solenoid is energized and gas is supplied to said pilot burner when the thermostat switch is closed;

a first storage capacitor;

a flame sensor voltage step-up transformer with a primary winding connected across said input terminals and a secondary winding connected to said first capacitor forming a series combination for connection across said flame sensor and pilot burner;

an ignition circuit for connection to said ignition electrodes;

a first switching circuit connected across said input terminals and operable between a first condition connecting said input terminals to the input of said ignition circuit turning said ignition circuit on to provide sparking at said electrodes, and a second condition connecting said input terminals to said main solenoid turning said ignition circuit off and supplying gas to said main burner; and a control circuit for said switching circuit, said control circuit comprising a field effect transistor, a second storage capacitor, a first diode, first means connecting the gate of said transistor to the junction of said transformer secondary winding and said first capacitor, second means connecting the source and drain of said transistor in series with said second capacitor and first diode across said input terminals, a first resistor connected across said source and drain and second capacitor, and third means connecting the transistor and second capacitor interconnection to said switching circuit in controlling relation whereby a flame sensed at said pilot burner actuates said switching circuit from said first condition to said second condition.

2. A system as defined in claim 1 wherein said first switching circuit includes a relay and a controlled rectifier having a gate, with said control circuit connected to said rectifier gate.

3. A system as defined in claim 2 wherein said third means includes a unilateral trigger diode.

4. A system as defined in claim 3 wherein said third means includes a second diode in series with said unilateral trigger diode.

5. A system as defined in claim 1 wherein the flame sensor, pilot burner, first capacitor loop is the only load on said transformer.

6. A system as defined in claim 1 wherein said power source provides about 24 volts ac to said input terminals and said transformer primary winding, and said transformer secondary winding provides about 48 volts ac to the flame sensor, pilot burner, first capacitor loop.

7. A system as defined in claim 1 wherein said first means includes a second current limiting resistor between said junction and transistor gate.

8. A system as defined in claim 7 including a third charge bleed resistor connected in parallel with said first capacitor.

9. A system as defined in claim 8 including a fourth current limiting resistor connected between said flame sensor and said secondary winding.

10. A system as defined in claim 9 including a fifth resistor connected across said fourth resistor, secondary winding and first capacitor.

11. A system as defined in claim 10 including a sixth charge bleed resistor connected between said transistor gate and said first capacitor.

12. A system as defined in claim 2 including a fuse element in series with the coil of said relay for disconnecting the coil of said relay and said controlled rectifier from said input terminals in the event of over current due to short circuiting.

13. A system as defined in claim 2 wherein said third means includes a second synchronized voltage switching circuit.

14. A system as defined in claim 13 wherein said second switching circuit includes a Darlington amplifier and resistance means connecting the base thereof to one of said input terminals.

15. A system as defined in claim 14 wherein said resistance means comprises second and third resistors connected in series providing a high gain, low base current mode of operation for said amplifier.

* * * * *